US005961113A

United States Patent [19]

Morris

[11] Patent Number: 5,961,113

[45] Date of Patent: Oct. 5, 1999

[54] SHEET FEEDING APPARATUS AND METHOD FOR RELIABLY FEEDING SHEETS FROM A COLUMN OF SHEETS

[75] Inventor: William I. Morris, Oakfield, N.Y.

[73] Assignee: Eastman Kodak Company, Rochester, N.Y.

[21] Appl. No.: 08/869,541

[22] Filed: Jun. 5, 1997

[51] Int. Cl.[6] ..... B65H 3/30

[52] U.S. Cl. ..... 271/22; 271/127; 271/160; 271/170

[58] Field of Search ..... 271/21, 22, 24, 271/121, 127, 126, 167, 169, 170

[56] References Cited

U.S. PATENT DOCUMENTS 3,919,972 11/1975 Komori et al. .
5,009,410 4/1991 Fuji et al. ..... 271/127
5,062,599 11/1991 Kriegel et al. ..... 271/121
5,398,108 3/1995 Morinaga et al. .
5,503,385 4/1996 Tsushima et al. ..... 271/170
5,669,601 9/1997 Fisher ..... 271/121

*Primary Examiner*—H. Grant Skaggs
*Attorney, Agent, or Firm*—Walter S. Stevens

[57] ABSTRACT

Sheet feeding apparatus and method for reliably feeding sheets from a column of sheets. The sheet feeding apparatus includes separation tangs each having a step-wise topography of reduced contact area for the sheets in order to reduce frictional drag on the sheets as the sheets are fed into an imaging apparatus. This allows for reliable feeding of the sheets because the reduced contact area of the separation tangs reduces contact time, as well as frictional drag, with the separation tangs. Moreover, the step-wise topography of the tangs individually separates each sheet from the column of sheets to be fed into the imaging apparatus in order to avoid multiple-feeding of the sheets.

10 Claims, 15 Drawing Sheets

SHEET FEEDING APPARATUS AND METHOD FOR RELIABLY FEEDING SHEETS FROM A COLUMN OF SHEETS

FIELD OF THE INVENTION

This invention generally relates to sheet supplying apparatus and methods and, more particularly, relates to a sheet feeding apparatus and method for reliably feeding sheets from a column of sheets, one sheet at a time.

BACKGROUND OF THE INVENTION

Sheet supply trays are commonly used with imaging devices, such as copiers, printers, facsimile machines and the like for supplying cut sheets to these devices in order to form an output image on each sheet. In this regard, a column of sheets are loaded in the tray which is then received in the imaging device. A roller mechanism belonging to the device engages the column of sheets to individually feed the sheets into a sheet guide path leading to a print head located in the device. The print head prints the output image on each sheet.

However, it has been observed that, occasionally, the sheets will inadvertently "multiple-feed" into the guide path. That is, two or more sheets will inadvertently feed from the supply tray and become jammed in the guide path. When this occurs, the device becomes inoperable until the jammed sheets are removed from the guide path. Alternatively, two or more of the sheets may be transported along the guide path and encounter the print head to become jammed at the print head, which may undesirably attempt to print the image on the multiple sheets jammed at the print head. In either event, the jammed sheets must be removed, usually by hand, resulting in lost time to remove the jammed sheets and wasted sheet stock. Therefore, a problem in the art is multiple-feeding of sheets from the sheet supply tray.

A device for separating and supplying sheets one by one from a sheet stack is disclosed in U.S. Pat. No. 5,398,108 titled "Sheet Supplying Apparatus Having a Plurality of Pressurizing Means" issued Mar. 14, 1995 in the name of Kazuyuki Morinaga, et al. This patent discloses an arrangement whereby, when a large number of sheets are stacked on an intermediate plate belonging to the arrangement, a plurality of pressurizing means are used to bias the intermediate plate with a force such that each sheet engages a feed roller with a predetermined pressure. On the other hand, when the number of the stacked sheets is small, a smaller number of the pressurizing means are used to bias the intermediate plate with a smaller force, so that each sheet engages the feed roller with substantially the same predetermined pressure. According to this patent, this arrangement allows the sheet supply pressure to be maintained substantially within an ideal range for eliminating poor sheet supply regardless of the number of sheets stacked on the intermediate plate. Moreover, this patent discloses a pair of separation pawls cooperating with the pressurizing means, which separation pawls are positioned for separating the sheets, one by one. However, each of Morinaga's, et al. separation pawls appear to be flat across its entire surface for making contact with a corner portion of the sheets. Therefore, it appears that the entire flat surface of each separation pawl is in contact with each sheet being fed, so that when the sheet begins to move out of the device the corner portion is dragged across the entirety of the flat surface. Thus, this flat configuration of each separation pawl causes the corner portion of the sheet to remain in contact with the separation pawl for a relatively longer time, thereby allowing frictional forces between the sheet and separation pawls to retard release of the sheet from the device. This in turn may allow a second sheet to begin feeding before the relatively slow-moving first sheet is completely released from the Morinaga, et al. device. Of course, this relatively slower feeding of the sheets could lead to the previously mentioned multiple-feeding problem. Hence, this patent does not appear to disclose a suitable sheet feeding apparatus having separation pawls adapted for reliably releasing the sheets from the intermediate plate to avoid multiple-feeding the sheets.

Therefore, what has long been needed is a sheet feeding apparatus and method for reliably feeding sheets from a column of sheets, one sheet at a time, in a manner that avoids multiple-feeding.

SUMMARY OF THE INVENTION

The present invention resides in a sheet feeding apparatus, having a separation member with a step-wise topography for individually separating sheets from a column of sheets pressed thereagainst. A support member has a plurality of segments for supporting the column of sheets. An articulated joint, associated with a predetermined one of the segments, presses the segment against the column of sheets with a predetermined force, so that the sheets press against the separation member with the predetermined force.

The present invention also resides in a sheet feeding method comprising the steps of providing a separation member having a step-wise topography for individually separating sheets from a plurality of sheets pressed thereagainst; providing a support member having a plurality of segments for supporting the plurality of sheets; and providing an articulated joint associated with a predetermined one of the segments for pressing the segment against the plurality of sheets with a predetermined force, so that the sheets press against the separation member with the predetermined force.

An object of the present invention is to provide a sheet feeding apparatus and method for reliably feeding sheets from a column of sheets, one sheet at a time, without multiple sheet feeding.

A feature of the present invention is the provision of a separation member having a step-wise topography for individually separating sheets from a column of sheets, one sheet at a time.

Another feature of the present invention is the provision of an articulated joint for pressing a segment of a sheet-bearing support plate against the column of sheets with a predetermined force.

An advantage of the present invention is that use thereof avoids multiple feeding of sheets into an imaging apparatus, which multiple sheet feeding would otherwise make the imaging apparatus inoperable.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

In the detailed description of the preferred embodiments of the invention presented hereinbelow, reference is made to the accompanying drawings, in which.

DETAILED DESCRIPTION OF THE INVENTION

Figure 1:
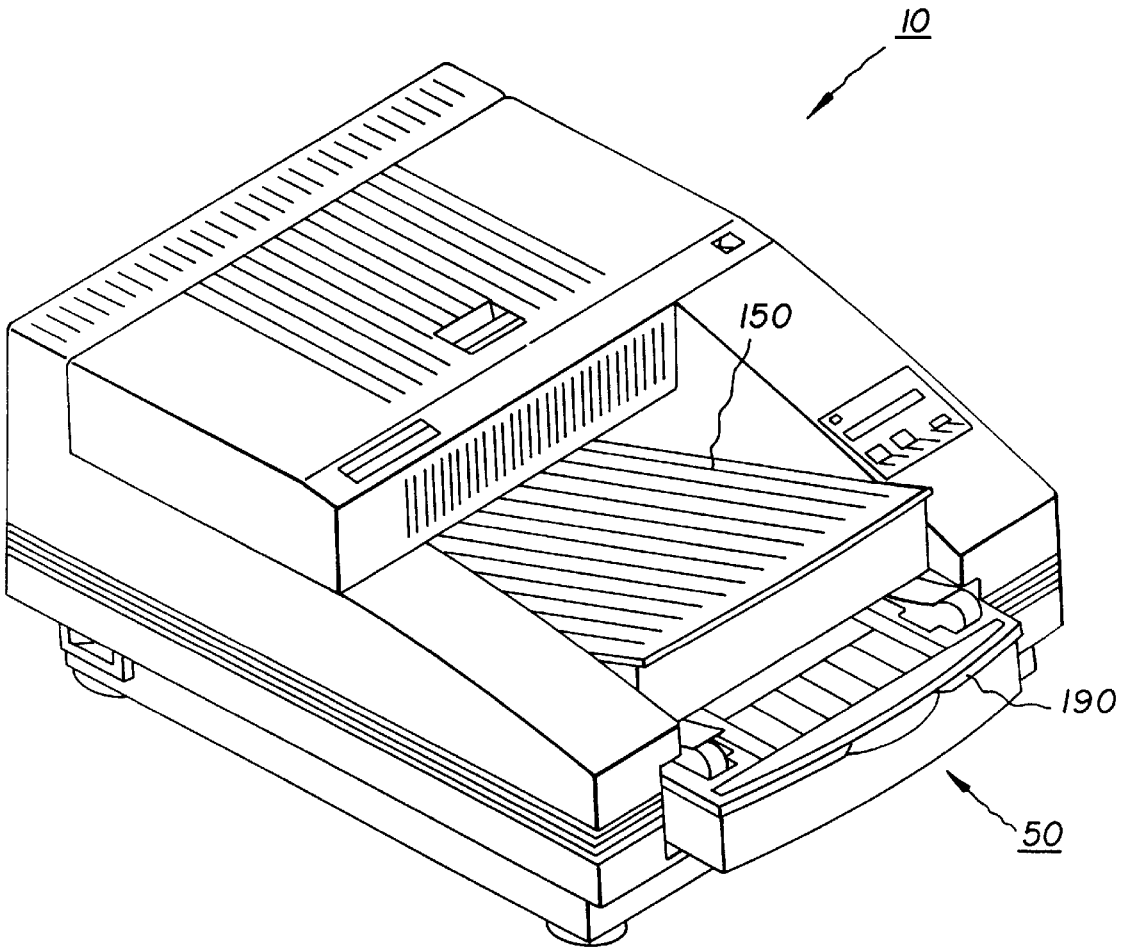
FIG. 1 is a view in perspective of a printer having a sheet feeding apparatus installed therein.
Figure 2:
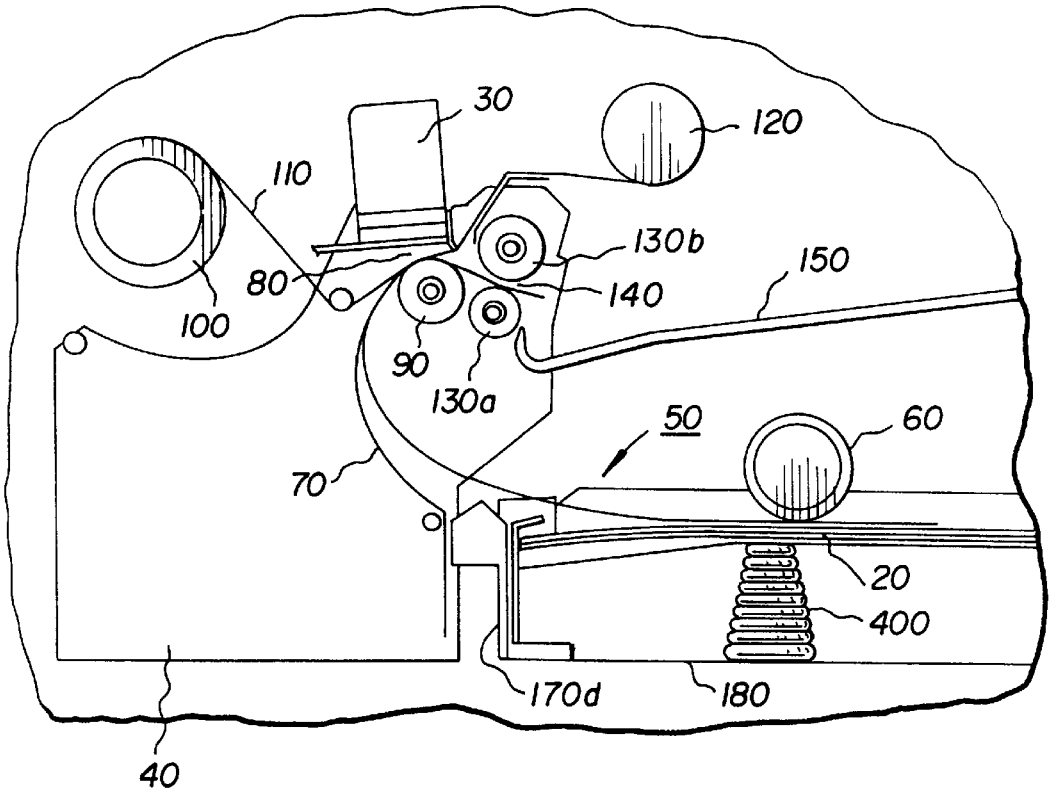
FIG. 2 is a view in elevation of the printer, with parts removed for clarity, showing the sheet feeding apparatus received therein.
Figure 3:
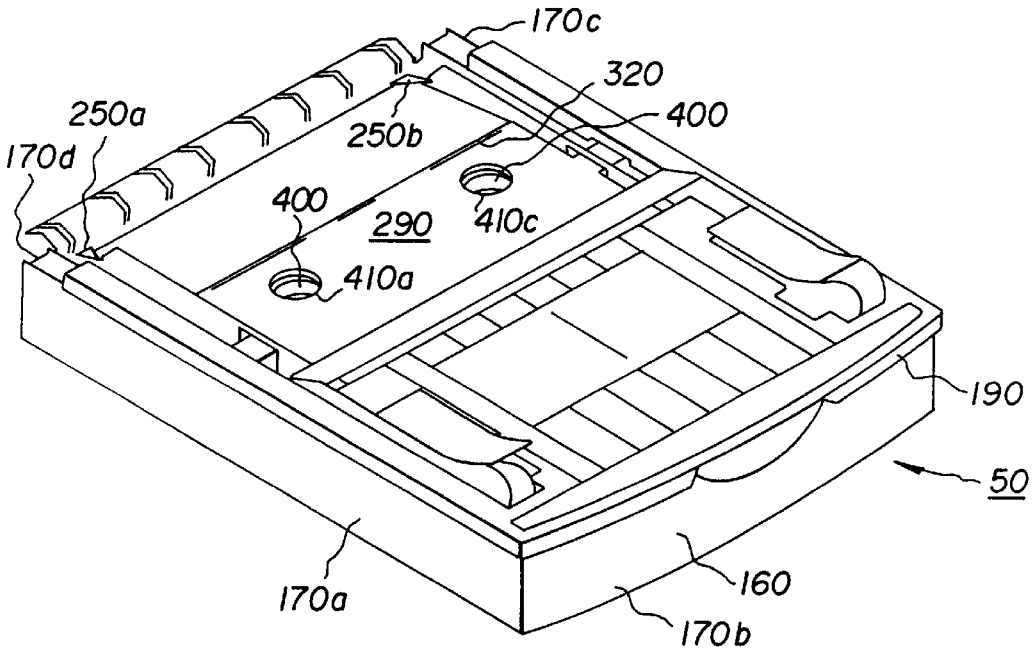
FIG. 3 is a view in perspective of the sheet feeding apparatus, this view also showing a support plate for supporting a column of cut sheets thereon.
Figure 4:
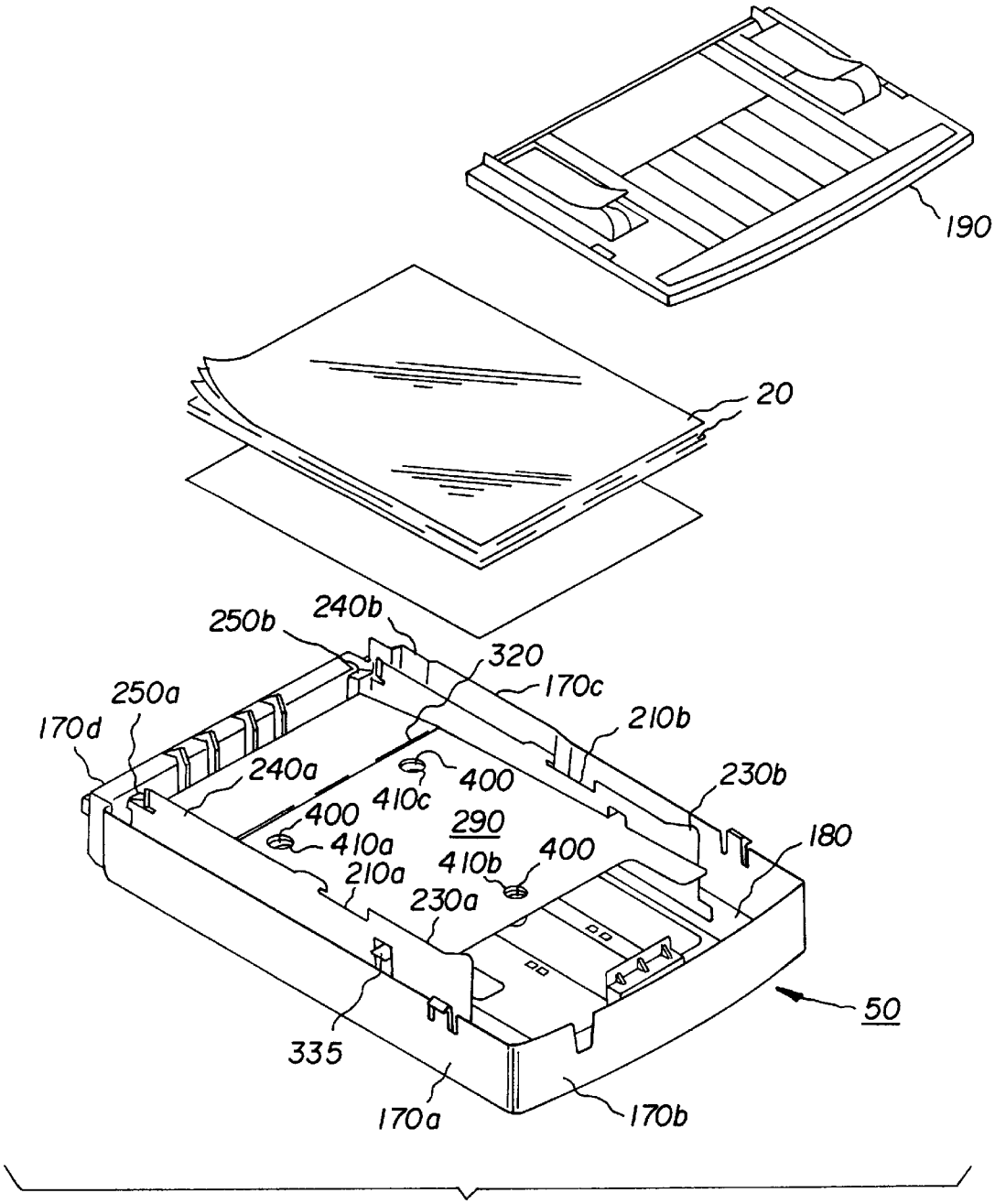
FIG. 4 is an exploded view in perspective of the sheet feeding apparatus.
Figure 5:
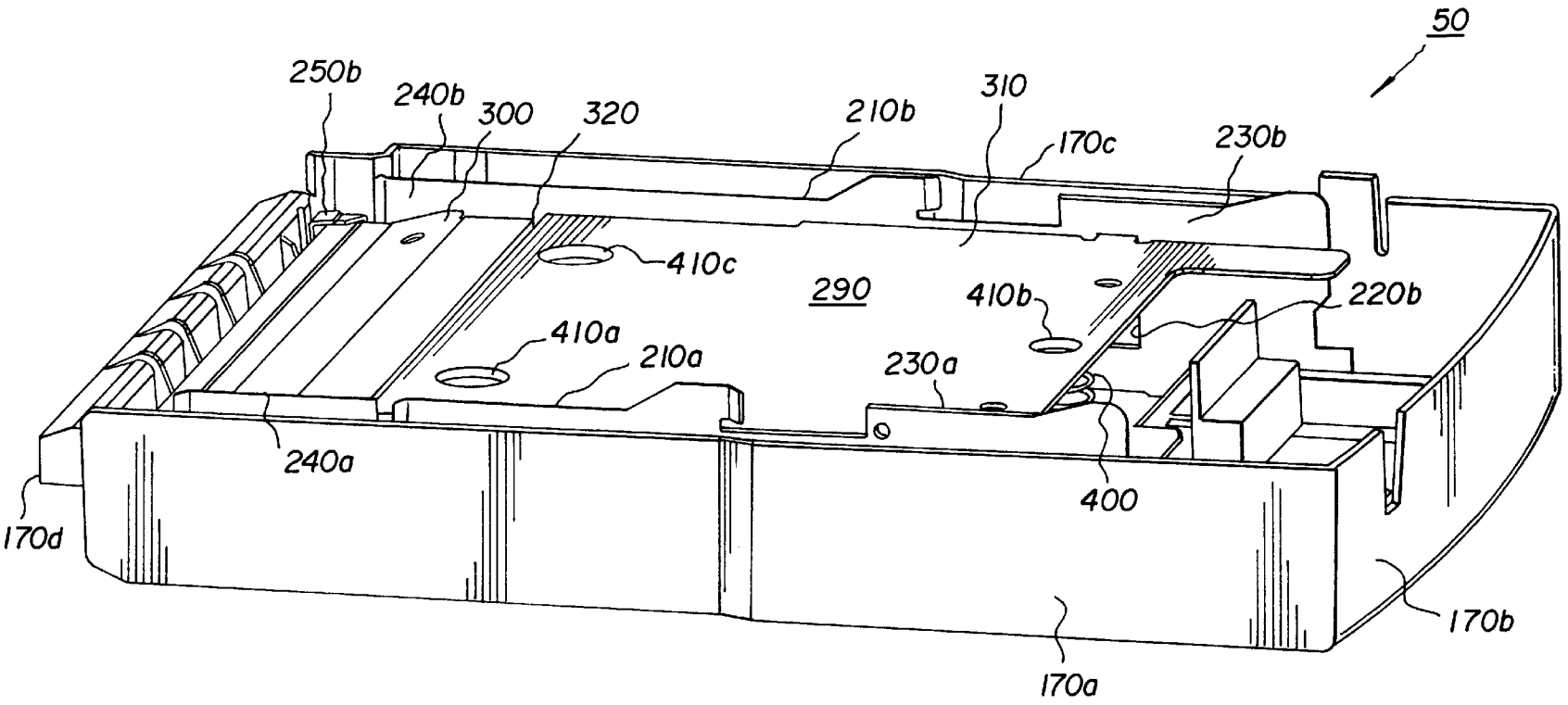
FIG. 5 is another view in perspective of the sheet feeding apparatus with the sheets removed for clarity.
Figure 6:
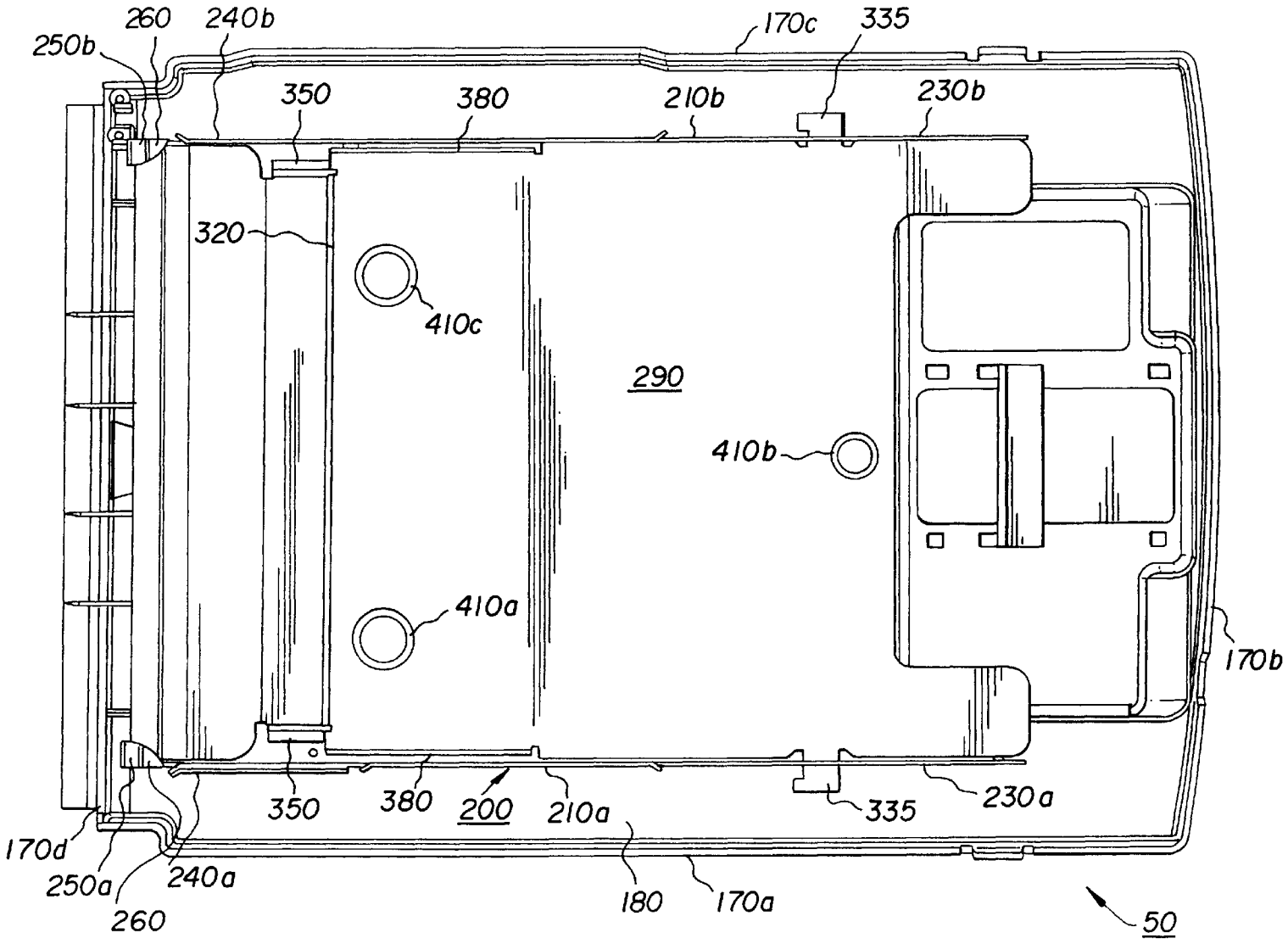
FIG. 6 is a plan view of the sheet feeding apparatus with the sheets removed for clarity.
Figure 7:
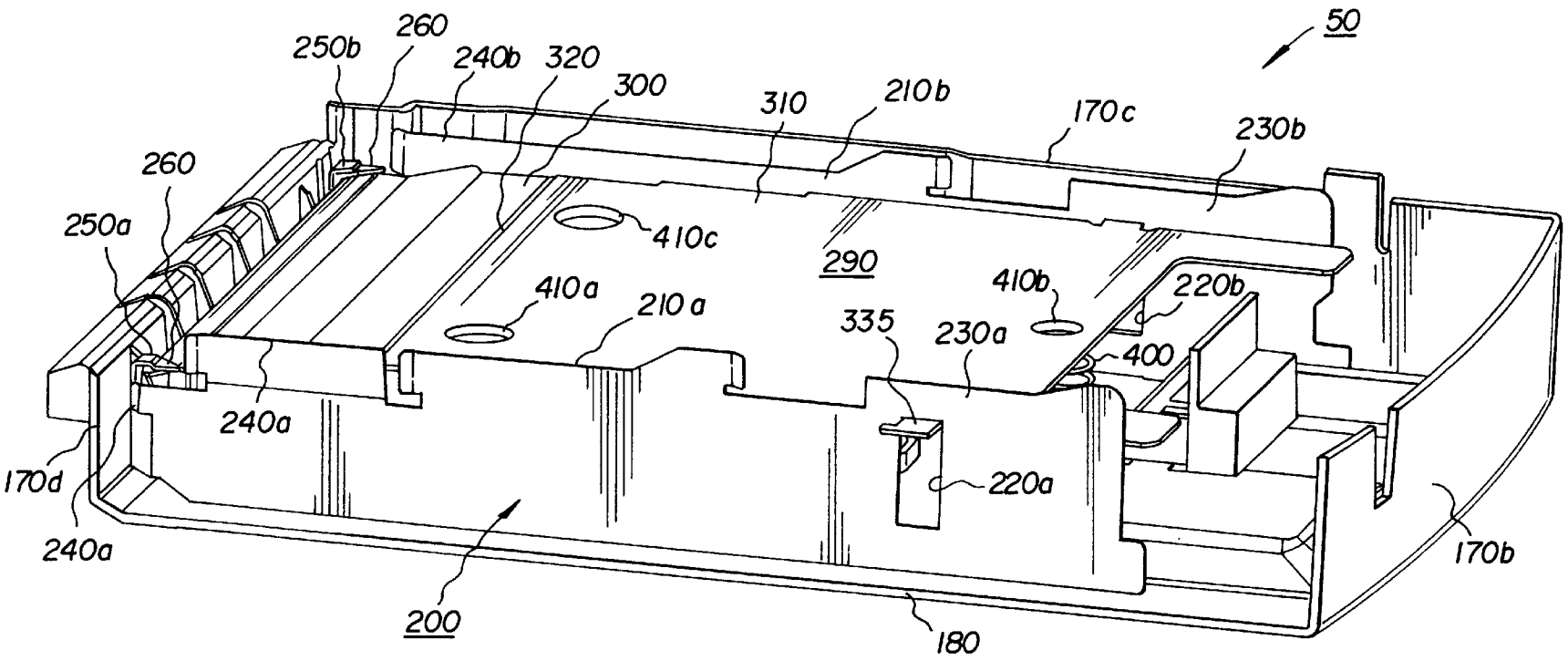
FIG. 7 is a perspective view in vertical section of the sheet feeding apparatus with a side wall thereof removed for showing a frame member having a pair of side panels, the sheets being removed for clarity.

Referring to FIGS. 1 and 2, there is shown an imaging apparatus such as a thermal printer, generally referred to as 10, for printing images on a receiver medium, which may comprise a column of cut sheets of coated paper or transparency 20. Although printer 10 is described herein as a thermal printer, persons of ordinary skill in the art to which the instant invention pertains will understand that printer 10 may be any type of printer (e.g., ink jet printer), copier, facsimile machine, or similar imaging device. In the case of the embodiment disclosed herein, printer 10 comprises a thermal resistive print head 30 connected to a supporting wall 40, so that print head 30 is suitably supported thereby. A sheet feeding apparatus, generally referred to as 50, is associated with print head 30 and holds a supply of cut sheets 20 therein. A "picker roller" 60 belonging to printer 10 is disposed near sheet feeding apparatus 50 to engage each cut sheet 20 in order to remove each cut sheet 20 from sheet feeding apparatus 50.

As best seen in FIG. 2, as each cut sheet 20 is removed from sheet feeding apparatus 50, it is intercepted by a guide member 70, which guides cut sheet 20 into a gap 80 defined between print head 30 and a platen roller 90. A motorized dye donor supply spool 100 having a supply of dye donor ribbon 110 wound thereabout is provided for supplying donor ribbon 110 to gap 80. In addition, a motorized dye donor take-up spool 120 preferably in synchronous operation with supply spool 100 is also provided for taking-up of donor ribbon 110 as donor ribbon 110 is unwound from about supply spool 100 and passes through gap 80. In this manner, dye donor ribbon 110 traverses print head 30 as it extends from supply spool 100, through gap 80, and thence to take-up spool 120. A receiver medium transport mechanism, such as a plurality of spaced-apart motorized rollers 130*a*/130*b*, engage cut sheet 20 to assist in feeding cut sheet 20 through gap 80. In this regard, rollers 130*a*/130*b* define a nip 140 for receiving cut sheet 20 therebetween, which rollers 130*a*/130*b* are adapted to close nip 140 in order that rollers 130*a*/130*b* can engage cut sheet 20. After passing through nip 140, cut sheet 20 is detected by a sensor (not shown), printed by operation of print head 30 and thereafter ejected from nip 140 to be deposited into an output tray 150 for retrieval by an operator of printer 10. Therefore, according to the description hereinabove, cut sheet 20 is "picked" from sheet feeding apparatus 50 by picker roller 60 and transported to guide member 70. Cut sheet 20 then advances along guide member 70 and thence into gap 80 which is defined between print head 30 and platen roller 90. As cut sheet 20 advances into gap 80, print head 30 moves toward platen roller 90 to press dye donor ribbon 110 and cut sheet 20 against platen roller 90 in order to form a sandwich-like structure, as shown. As the sandwich-like structure is formed, heat from thermal print head 30 causes dye in dye donor ribbon 110 to transfer to cut sheet 20 in order to print an output image on cut sheet 20.

However, in the case of prior art sheet supply trays, such as disclosed in the previously mentioned U.S. Pat. No. 5,398,108, cut sheet 20 may tend not to separate completely or singularly from the column of sheets. That is, two or more sheets 20 may inadvertently feed from such a prior art tray and become jammed in the guide path defined by guide member 70. When this occurs, printer 10 becomes inoperable until the jammed sheets 20 are manually removed from the guide path. This results in lost time to remove the jammed sheets 20 and also results in wasted sheet stock. As described more fully hereinbelow, the instant invention provides a sheet feeding apparatus and method for reliably feeding sheets 20, one sheet at a time, without multiple feeding of sheets 20.

Therefore, referring to FIGS. 3, 4, 5 and 6, there is shown sheet feeding apparatus 50 comprising an encasement 160 to accommodate the plurality of cut sheets 20 to be fed therefrom. Encasement 160 is box-shaped with an open top and includes a plurality of integrally connected side walls 170*a*/*b*/*c*/*d* and a base 180. A frame assembly, generally referred to as 200, includes a pair of upright parallel spaced-apart panels 210*a*/210*b* disposed perpendicularly with respect to base 180 and connected thereto. Each panel 210*a* and 210*b* has a vertically extending slot 220*a* and 220*b*, respectively, formed therethrough, for reasons disclosed hereinbelow. Each slot 220*a* and 220*b* is located in an anterior end portion 230*a* and 230*b* of panels 210*a* and 210*b*, respectively.

Referring to FIGS. 8A, 8B, 8C, 9, 10 and 11, integrally attached to a proximal end portion 240*a* and 240*b* of respective ones of panels 210*a* and 210*b* is a separation member, such as tangs 250*a* and 250*b*, for individually separating sheets 20. It is important to individually separate sheets 20 during feeding of sheets 20 because individually separating sheets 20 avoids multiple feeding of sheets 20 onto guide 70. More specifically, each tang 250*a*/250*b* has a step-wise topography for separating a first one 20*a* of sheets 20 from a second one 20*b* of sheets 20 during feeding of sheets 20 from sheet feeding apparatus 50. More specifically, the step-wise topography of separation tangs 250*a*/250*b* defines a downwardly-oriented step 260, as shown. Step 260 has an underside surface 270 configured to contact each sheet 20 (e.g., first sheet 20*a*) over a predetermined area 280 of underside surface 270. As described more fully hereinbelow, each sheet 20 will preferably only contact area 280 as sheet 20 travels from beneath underside surface 270. It is important that sheet 20 only contact area 280 as sheet 20 travels from beneath underside surface 270. This is important because the reduced area 280 where sheet 20 contacts underside surface 270 reduces the time available for sliding frictional forces to act upon sheet 20 in order to slow-down release of sheet 20 from beneath underside surface 270 during the sheet separation process. In this manner, separation tangs 250*a*/250*b* function to reliably release the comers of sheet 20 from confinement under separation tangs 250*a*/250*b*.

Figure 10:
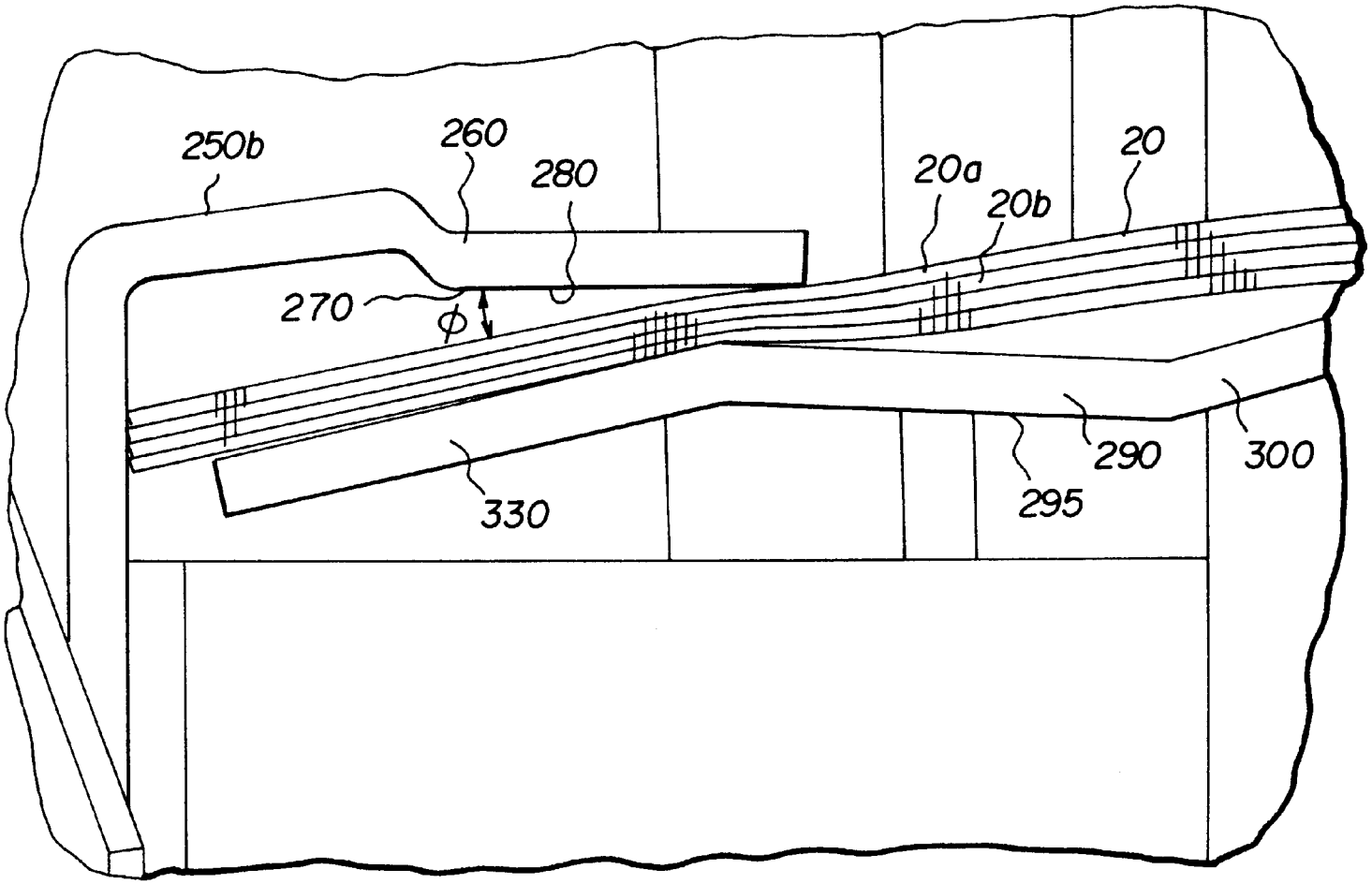
FIG. 10 is an enlarged fragmentation view in elevation of the sheet feeding apparatus showing an angle Φ defined between a stepped portion of the separation tang and the column of sheets.
Figure 11:
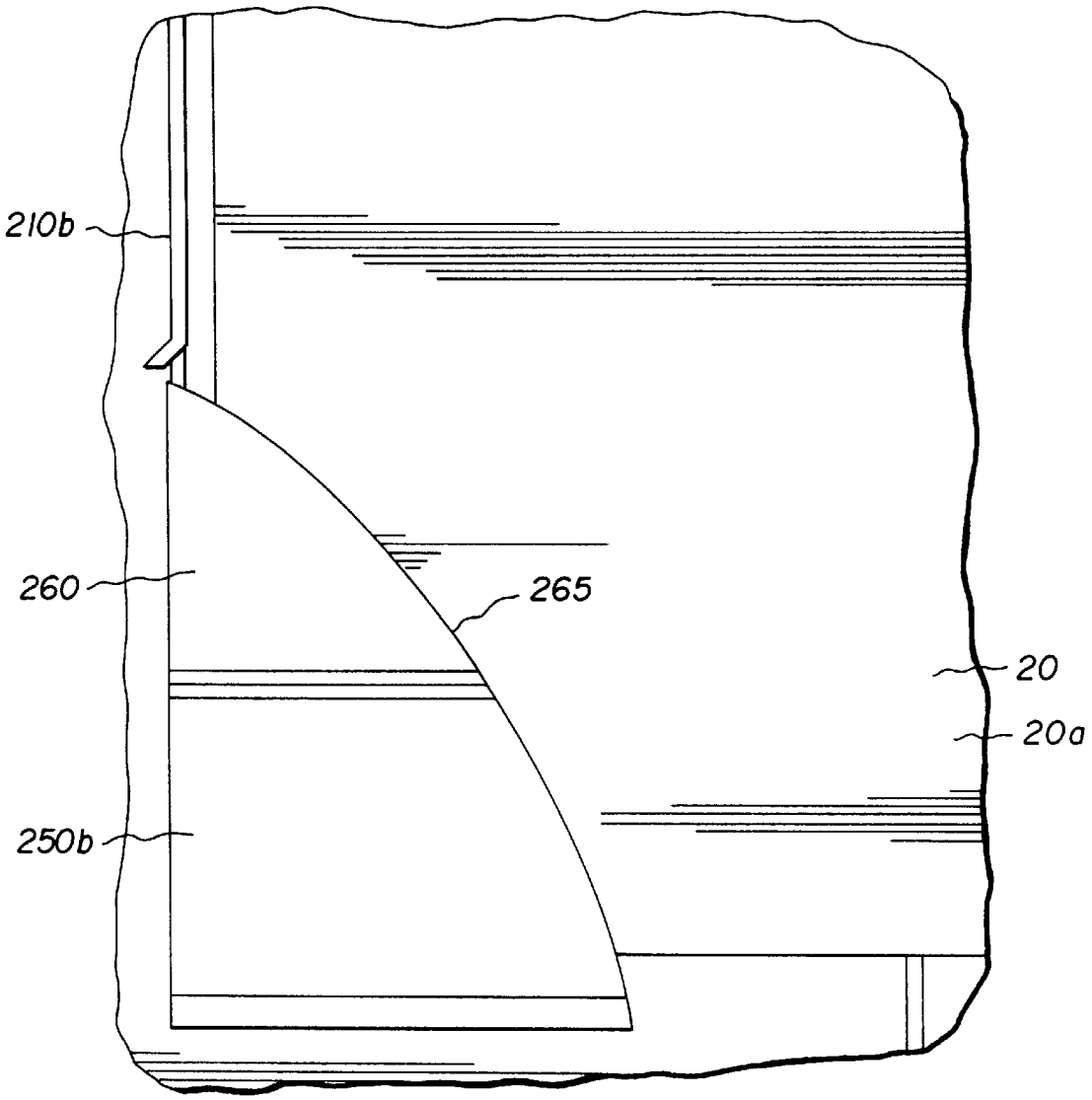
FIG. 11 is an enlarged fragmentation plan view of the separation tang and a top-most one of the sheets disposed beneath the separation tang.
Figure 12:
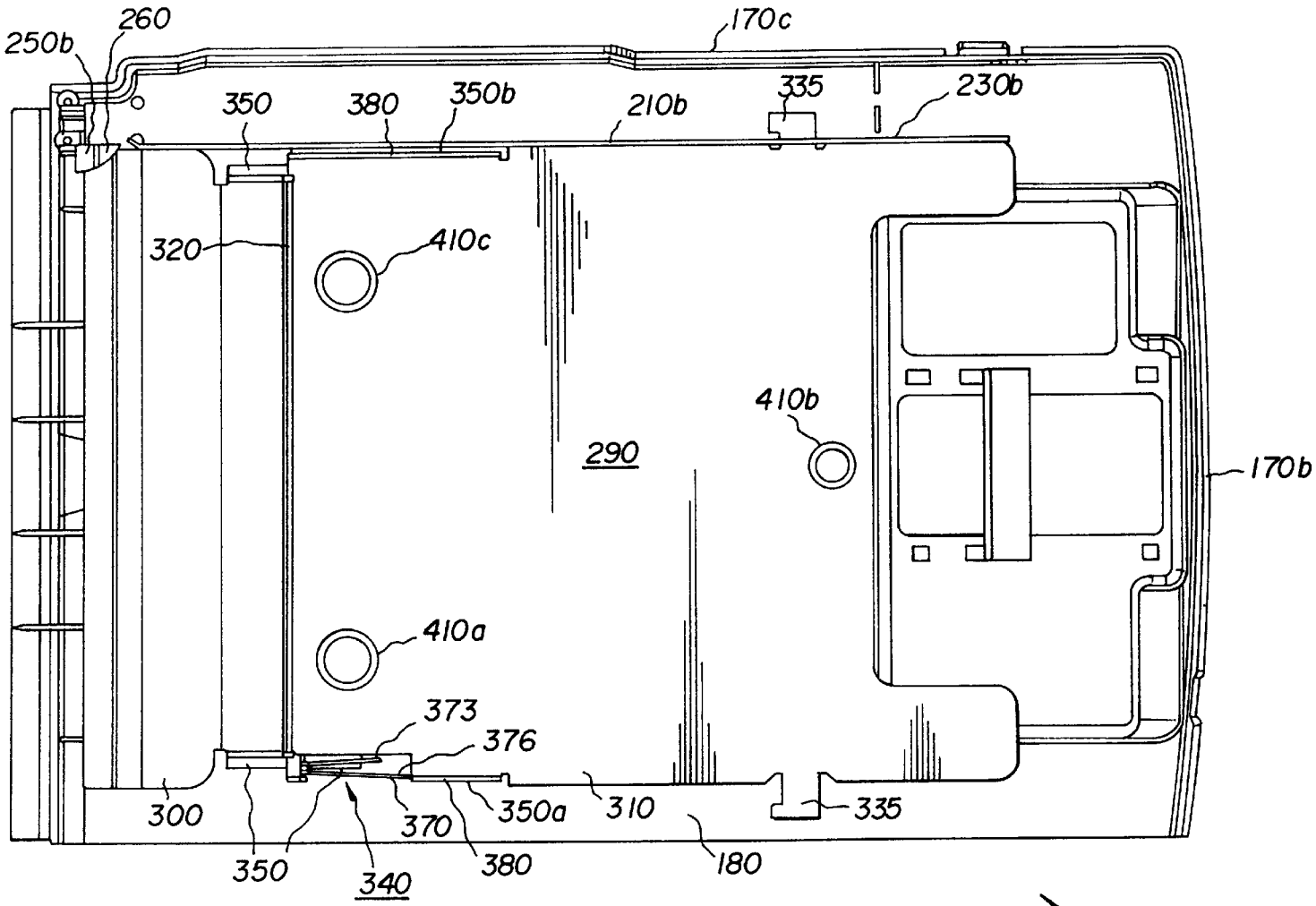
FIG. 12 is a plan view in partial horizontal section of the sheet feeding apparatus showing one of the side panels removed and also showing an articulated joint.
Figure 13:
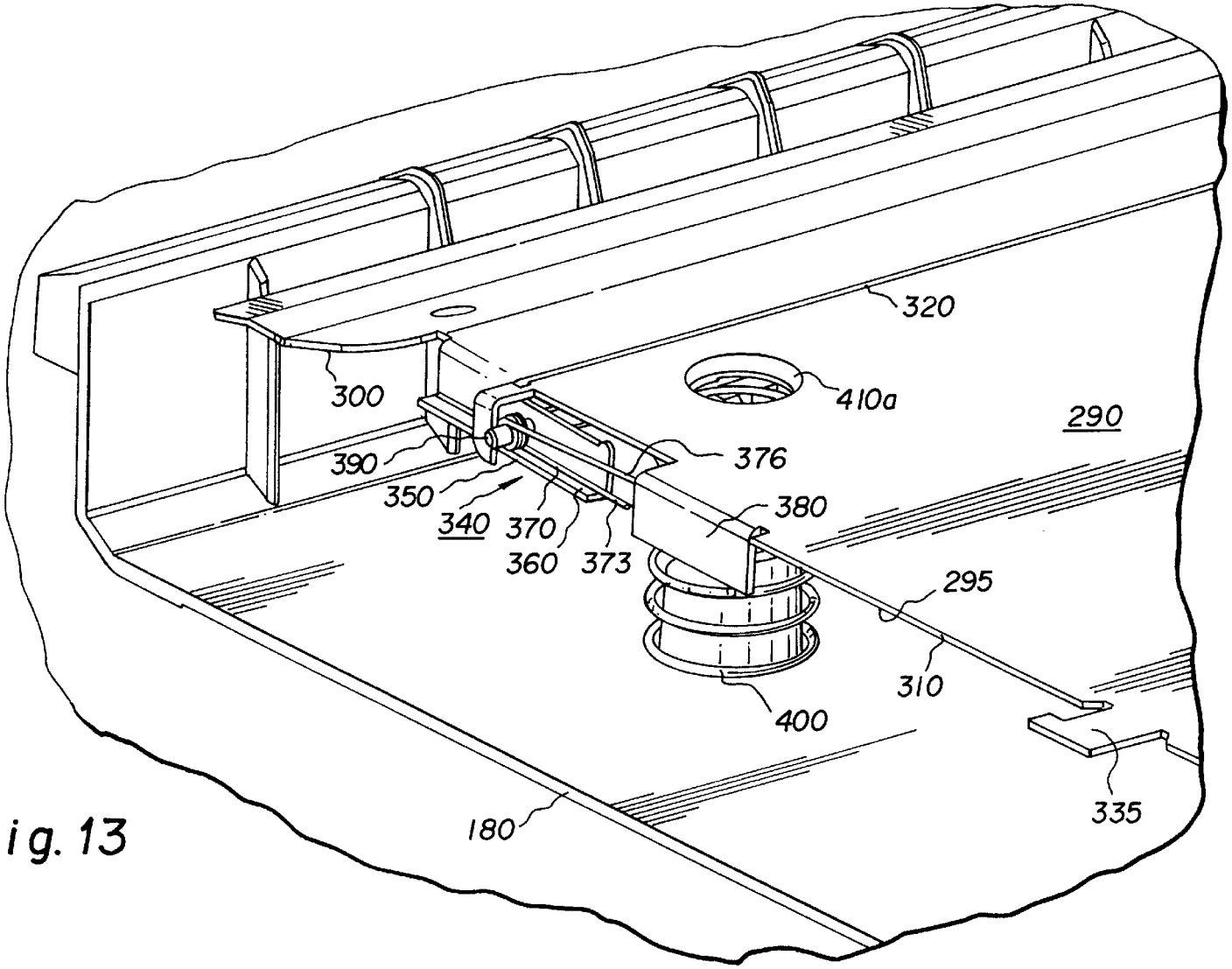
FIG. 13 is a perspective view in vertical section of the sheet feeding appears showing the hinge.

Turning now to FIGS. 10, 12 and 13, associated with encasement 160 is a support member, such as generally rectangularly-shaped support plate 290, disposed inwardly of panels 210*a* and 210*b* for supporting sheets 20 thereon. Support plate 290 has a bottom surface 295 and includes a plurality of segments, such as a first segment 300 and a second segment 310. First segment 300 is pivotally connected, in the manner disclosed hereinbelow, to second segment 310 so that first segment 300 and second segment 310 define an interface 320 therebetween. First segment 300 defines a canted lip portion 330 so as to define an angle Φ of about 15 degrees with respect to the contact surface defined by area 280 and top-most sheet 20*a*. This angular relationship between sheets 20 and area 280 is best seen in FIG. 10. It is appreciated from the description hereinabove that lip portion 330 serves two functions. First, lip portion 330 supports a proximal end portion of sheets 20, which lay atop lip portion 330. Secondly, lip portion 330 allows each sheet 20 to contact step 260, and thus separation tangs 250*a*/*b*, only at area 280 of underside surface 270. This is so because lip portion 330 "slopes-away" (i.e., is downwardly canted) from underside surface 270 due to the downwardly angled configuration of lip portion 330.

Referring to FIGS. 12 and 13, second segment 310 of support plate 290 includes a pair of tabs 335 laterally outwardly projecting from second segment 310 and sized to slidably engage the previously mentioned slots 220*a* and 220*b* formed in panels 210*a* and 210*b*, respectively. Thus, as the weight of sheet column 15 downwardly translates support plate 290, each tab 335 will slide in its respective slot 220*a* and 220*b* in a manner that downwardly guides vertical translation of support plate 290. Conversely, as weight of sheets 20 is reduced resulting from sheets 20 being fed from apparatus 10, each tab 335 will slide in its respective slot 220*a* and 220*b* in a manner that upwardly guides vertical translation of support plate 290. Of course, the rate of downward and upward translation of support plate 290 is controlled. As described more fully hereinbelow, a resilient force acts on support plate 290 to control the rate of downward and upward translation of support plate 290.

Referring again to FIGS. 12 and 13, interconnecting first segment 300 and second segment 310 are a pair of articulated joints (only one of which is shown), generally referred to as 340. One each of joints 340 is located on either lateral side 350*a*/350*b* of support plate 290. In this regard, each articulated joint 340 comprises a bracket member 350 integrally attached to first segment 300. Bracket member 350 defines a channel 360 therein for receiving a spring member, such as a torsion spring 370, having a first arm 373 disposed substantially within channel 360 and a second arm 376 outwardly extending from channel 360 and connected to bottom surface 295 of support plate 290. Second arm 376 is connected to bottom surface 295, such as being captured by a flange 380 over-hanging a marginal edge of support plate 290. Torsion spring 370 is anchored to first segment 300, such as being wrapped around an elongate cylindrical post 390, which post 390 passes through bracket member 350 and extends adjacent interface 320 from one lateral side 350*a* to another lateral side 350*b* of support plate 290. Thus, each torsion spring 370 belonging to each articulated joint 340 and which is wrapped around post 390 functions as a spring-actuated hinge. Therefore, as support plate 290 is downwardly translated by weight of sheet column 15, a predetermined force exerted thereon is transferred to second arm 376 of torsion spring 370 because second arm 376 is connected to support plate 290, as previously described. In addition, as the above mentioned force is transferred to second arm 376, this force is in turn transferred to first arm 373 of torsion spring 370 because first arm 373 and second arm 376 are integrally connected to form torsion spring 370. Moreover, as the above mentioned force is transferred to first arm 373 of torsion spring 370, this force is in turn transferred to first segment 300 of support plate 290 because first arm 373 lays within channel 360 that is formed in bracket member 350. Of course, bracket member 350 is integrally connected to first segment 300. Therefore, as second segment 310 of support plate 290 is downwardly translated, first segment 300 is forcibly inclined upwardly an amount proportional to the weight of the column of sheets 20 due to the transfer of forces caused by the hinging action of articulated joints 340. In this manner, the amount of upwardly force acting against reduced area 280 of separation tangs 250*a*/250*b* is predetermined regardless of the weight of the column of sheets 20 and is determined by the spring constant of torsion spring 370 which comprises articulated joint 340.

Figure 8A:
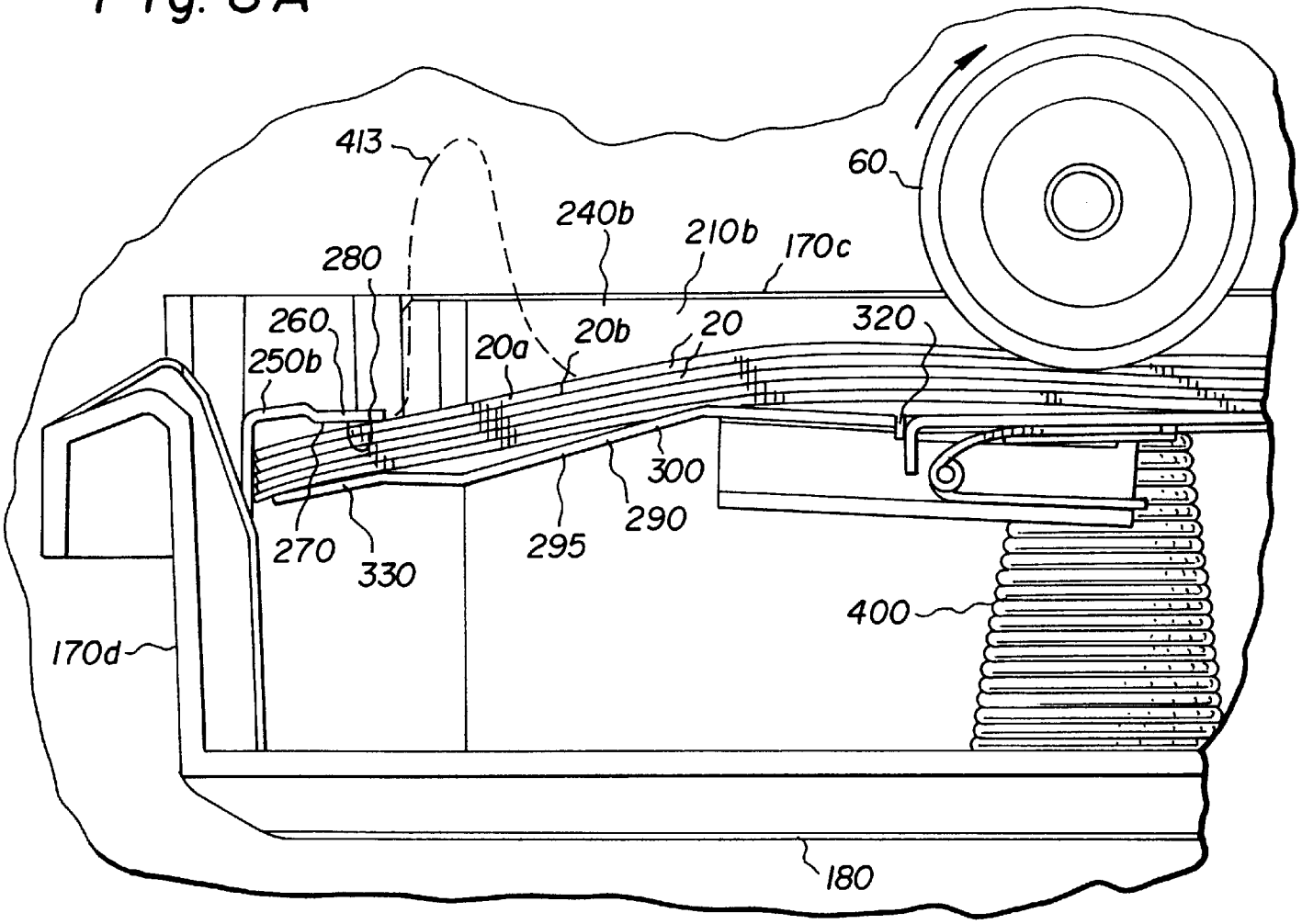
FIG. 8A is an enlarged fragmentation view in elevation showing a hinge and a separation tang having a step-wise topography, this view also showing, in phantom, a first position of a sheet being fed from the sheet feeding apparatus.
Figure 8B:
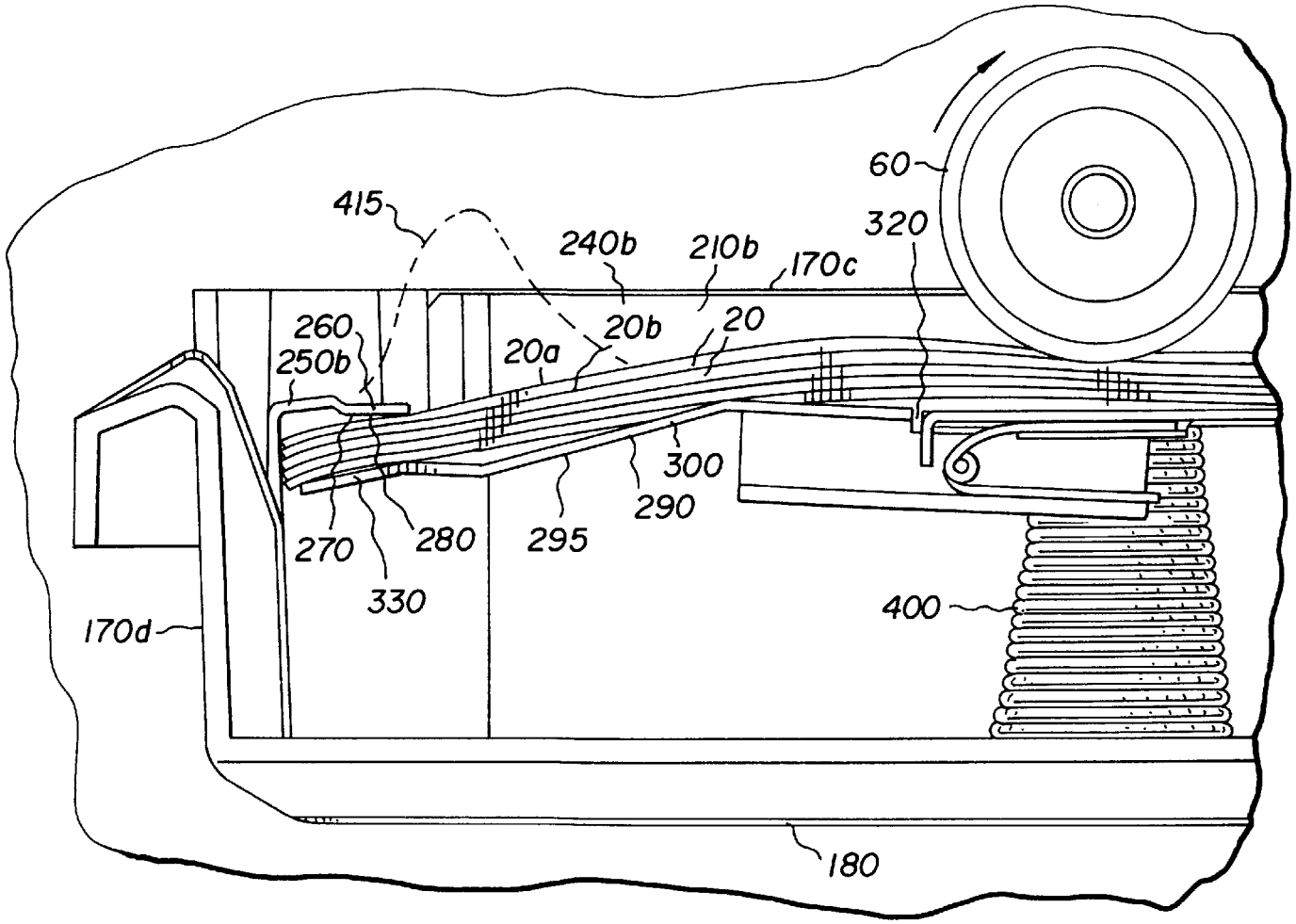
FIG. 8B is an enlarged fragmentation view in elevation showing the hinge and the separation tang having the step-wise topography, this view also showing, in phantom, a second position of the sheet being fed from the sheet feeding apparatus.
Figure 8C:
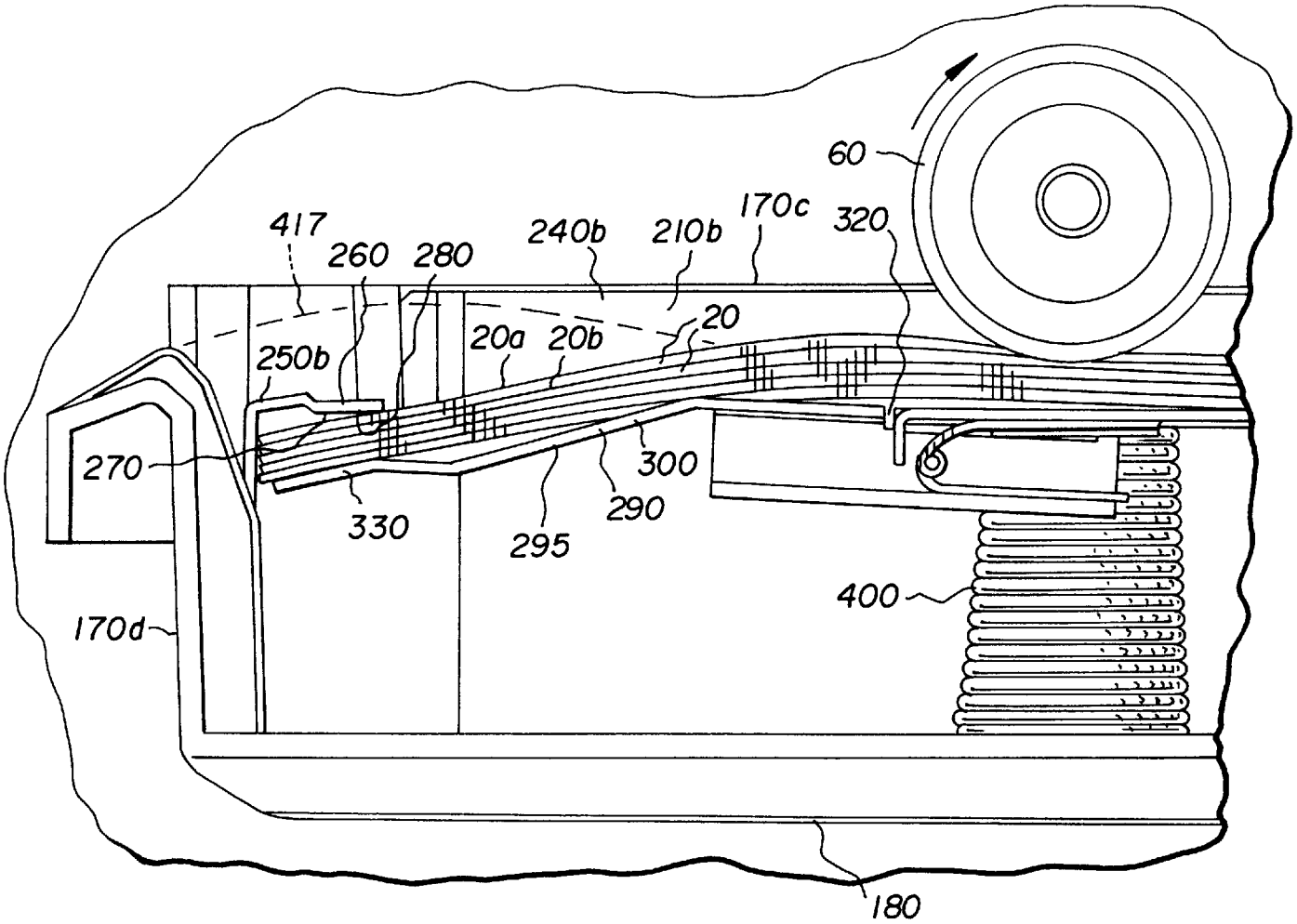
FIG. 8C is an enlarged fragmentation view in elevation showing the hinge and the separation tang having the step-wise topography, this view also showing, in phantom, a third position of the sheet being fed from the sheet feeding apparatus.
Figure 8D:
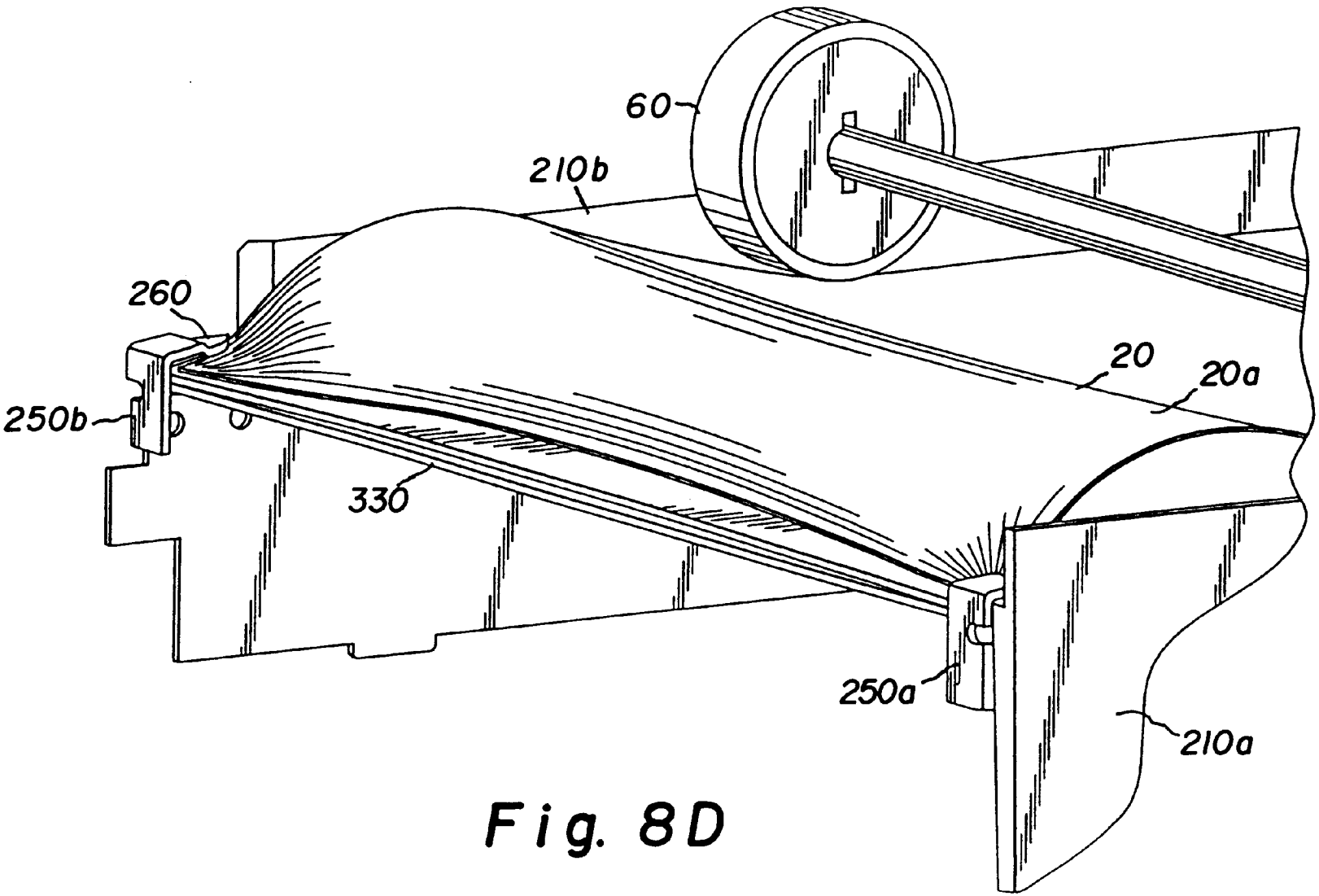
FIG. 8D is a view in perspective of the sheet buckling as the sheet feeds from the sheet feeding apparatus.
Figure 9:
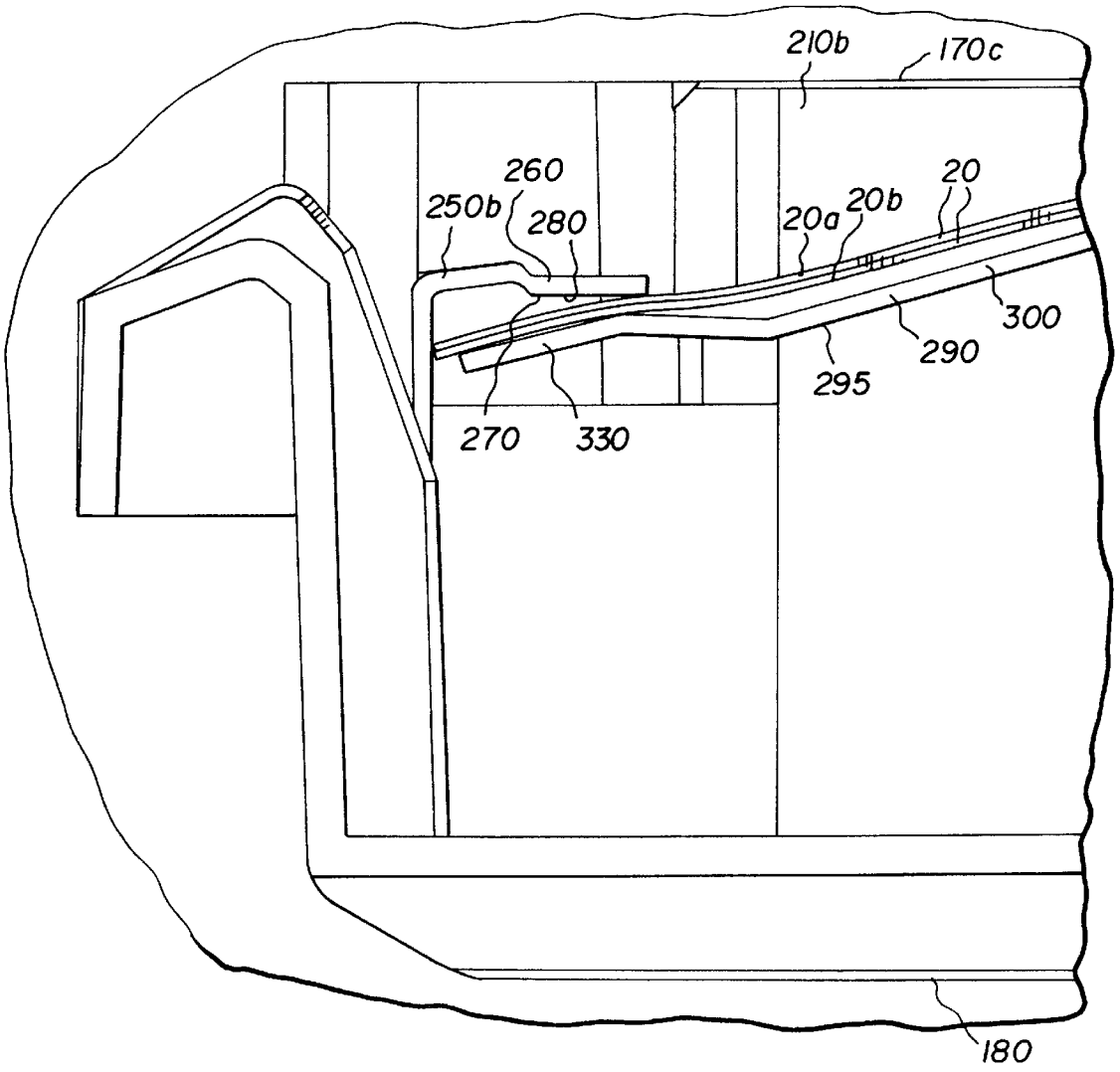
FIG. 9 is an enlarged fragmentation view in partial vertical section showing the separation tang and the column of sheets interposed between the separation tang and the support plate.

Referring now to FIGS. 2, 6, 8A, 8B, 8C and 13, a plurality of resilient biasing members, such as helical springs 400, are connected to support plate 290, as at locations 410*a*/*b*/*c*, for upwardly biasing support plate 290 so that the proximal end portion of each sheet 20 is in turn upwardly biased against contact area 280 of separation tangs 250*a*/*b*. In this manner, the topmost sheet 20*a* will always bear against reduced area 280 and will be confined thereunder until feed roller 60 is operated to withdraw sheet 20*a* from area 280 and thereafter reliably release sheet 20*a* from its confinement under separation tangs 250*a*/250*b*. As best seen in FIGS. 8A, 8B and 8C, the progressive withdrawal of sheet 20*a* from its confinement under separation tangs 250*a*/250*b* is shown, wherein a plurality of dashed lines illustrate a substantially-confined position 413 of sheet 20*a*, a partially-released position 415 of sheet 20*a*, and a fully-released position 417 of sheet 20*a*, respectively. Use of the invention, which includes the step-wise topography and reduced area 280 of separation tangs 250*a*/*b*, allows sheet 20*a* to more reliably progress from the substantially-confined position 413 to the fully-released position 417, compared to prior art devices such as disclosed in U.S. Pat. No. 5,398,108.

Moreover, referring to FIGS. 8A, 8B, 8C, 8D and 10, cut sheet 20 to be fed from sheet feeding apparatus 50 is initially disposed substantially parallel to base 180; except, however, that a portion thereof will slope downwardly toward base 180 as sheet 20 resides beneath step 260 in order to allow cut sheet 20 to be more easily engaged by picker roller 60. When picker roller 60 is downwardly biased by appropriate means (not shown) and engages top-most sheet 20*a*, cut sheet 20*a* is driven forward (i.e., toward side-wall 170*d*). As cut sheet 20*a* is driven forward by picker roller 60, cut sheet 20 buckles toward the front of encasement 160 because separation tangs 250*a*/*b* still hold the front corners of cut sheet 20 in place. Moreover, cut sheet 20*a* experiences a sideways or widthwise "shrinking" (i.e., reduction in the widthwise dimension of cut sheet 20*a*). This is so because an upwardly directed bowing is produced in cut sheet 20*a* as cut sheet 20*a* experiences the sideways or widthwise shrinking. In this manner, the portion of cut sheet 20*a* that is restrained under separation tangs 250*a*/*b* starts to slide around the radial-shaped edge of separation tangs 250*a*/*b* in order that cut sheet 20 buckles in the previously mentioned upwardly and forwardly directions. Thus, as cut sheet 20*a* slides around the aforementioned radial-shaped edge of tangs 250*a*/*b*, the width of cut sheet 20*a* reduces because cut sheet 20*a* is buckling and rising. That is, as cut sheet 20*a* buckles and rises, the portion of cut sheet 20*a* residing beneath separation tangs 250*a*/*b* narrows or decreases. When this narrowing occurs, cut sheet 20*a* slides around the radius of the corner of each separation tang 250*a*/250*b*. As cut sheet 20 slides around the radius of the corner of separation tangs 250*a*/*b*, angle Φ occurs between the bottom of separation 250*a*/*b* and the slope of cut sheet 20*a*, which is temporarily restrained under separation tangs 250*a*/250*b*. When the appropriate position is reached, such as location 265 (see FIG. 11), angle Φ generated by cut sheet 20*a*, as cut sheet 20 slides around the radius of the corner of separation tangs 250*a*/*b*, becomes wider than the thickness of the cut sheet 20*a*. At this point, cut sheet 20*a* is released from any significant pressure exerted on cut sheet 20*a* by separation tangs 250*a*/*b*; however, vertical translation of cut sheet 20*a* is still by being restrained under the remaining portion of separation tangs 250*a*/*b*. However, this restraint on cut sheet 20*a* does not impede the forward speed because the pressure exerted by separation tangs 250*a*/*b* is not sufficient to impede the forward movement of cut sheet 20*a*. Thereafter, cut sheet 20*a* is released from sheet feeding apparatus 50 with less upward buckling. Any tendency of cut sheet 20*a* to be folded over is lessened because less buckling means less of cut sheet 20*a* extends between the roller and separation tangs 250*a*/*b*. That is, cut sheet 20*a* is not substantially held or captured by pressure of separation tangs 250*a*/*b*; rather, cut sheet 20*a* slides from beneath separation tangs 2450*a*/*b*. This is so, because as cut sheet 20*a* is released from beneath separation tangs 250*a*/*b*, the angle Φ becomes greater that the thickness of cut sheet 20*a*.

It is appreciated from the teachings herein, that an advantage of the present invention is that use thereof pertains to reliably feeding of sheets from a column of sheets to be fed into an imaging apparatus, while simultaneously avoiding multiple feeding of sheets, which multiple feeding would otherwise make the imaging apparatus inoperable. This is so because the reduced area topography of separation tangs 250*a*/*b* allows each sheet 20 to spend less time in contact with separation tangs 250*a*/250*b*, thereby resulting in less frictional drag between each sheet 20 and tangs 250*a*/*b*.

While the invention has been described with particular reference to a preferred embodiment, it will be understood by those skilled in the art that various changes may be made and equivalents may be substituted for elements of the preferred embodiment without departing from the invention. In addition, many modifications may be made to adapt a particular situation and material to a teaching of the present invention without departing from the essential teachings of the invention. For example, the separation members may have any suitable topography rather than the specific step-wise topography disclosed herein.

Therefore, what is provided is a sheet feeding apparatus and method for reliably feeding sheets from a column of sheets, one sheet at a time.

PARTS LIST

10 . . . printer
15 . . . column of sheets
20 . . . receiver medium
30 . . . print head
40 . . . supporting wall
50 . . . sheet feeding apparatus
60 . . . picker roller
70 . . . guide member
80 . . . gap
90 . . . platen roller
100 . . . dye donor spool
110 . . . dye donor ribbon
120 . . . dye donor take-up spool
140 . . . nip
150 . . . output tray
160 . . . encasement
170*a*/*b*/*c*/*d* . . . side-walls
180 . . . base
190 . . . cover
200 . . . frame assembly
210*a*/*b* . . . panels
220*a*/220*b* . . . slots
230*a*/*b* . . . anterior end portion
240*a*/*b* . . . proximal end portion
250*a*/*b* . . . separation tangs
260 . . . step
265 . . . position/location
270 . . . underside surface
280 . . . contact area
290 . . . support plate
295 . . . bottom surface
300 . . . first segment
310 . . . second segment
320 . . . interface
330 . . . lip portion
335 . . . tabs
340 . . . articulated joint
350 . . . bracket member
360 . . . channel
370 . . . torsion spring
373 . . . first portion (of torsion spring)
376 . . . second portion (of torsion spring)
380 . . . flange
390 . . . post
400 . . . helical spring
410*a*/*b*/*c* . . . locations
413 . . . substantially-confined position (of sheet 20*a*)
415 . . . partially-released position (of sheet 20*a*)
417 . . . fully-released position (of sheet 20*a*)

What is claimed is:

1. A sheet feeding apparatus comprising:

(a) a separation member having a step-wise topography for individually separating sheets from a column of sheets pressed thereagainst, the step-wise topography defining a downwardly-oriented step having an underside surface configured to contact each sheet over a predetermined area of the underside surface;

(b) a picker mechanism associated with said separation member, said picker mechanism adapted to engage individual ones of the sheets to feed the sheets from the column of sheets;

(c) a support member having a plurality of segments for supporting the column of sheets;

(d) an articulated joint associated with a predetermined one of the segments for pressing the segment against the column of sheets with a predetermined force, so that the sheets press against said separation member with the predetermined force; and (e) a biasing member connected to said support member for biasing said support member, so that the column of sheets supported by said support member contacts said separation member.

2. A sheet feeding apparatus comprising:

(a) an encasement for accommodating a plurality of sheets to be fed therefrom;

(b) a separation member connected to said encasement and having a step-wise topography for individually separating the plurality of sheets, the step-wise topography defining a downwardly-oriented step having an underside surface configured to contact each sheet over a predetermined area of the underside surface;

(c) a picker mechanism associated with said encasement, said picker mechanism adapted to engage individual ones of the sheets to pick the sheets from the encasement;

(d) a support member associated with said encasement for supporting the plurality of sheets thereon, said support member having a canted segment thereof for pressing the plurality of sheets against said separation member;

(e) an articulated joint connected to the canted segment for pressing the canted segment against the plurality of sheets with a predetermined force, so that the column of sheets presses against said separation member with the predetermined force; and (f) a biasing member connected to said support member for biasing said support member, so that the plurality of sheets supported by said support member contacts said separation member.

3. The sheet feeding apparatus of claim 2, wherein said picker mechanism comprises a feed roller.

4. A sheet feeding apparatus comprising:

(a) a box-shaped encasement for accommodating a plurality of cut sheets to be fed therefrom;

(b) a separation tang connected to said encasement and having a step-wise topography for separating a first one of the sheets from a second one of the sheets as the sheets feed from said encasement, said separation tang having a downwardly-oriented step therein defined by the step-wise topography of said tang, the step having an underside surface of reduced contact area for contacting the first one of the sheets, so that the first one of the sheets has reduced contact time with said separation tang as the first one of the sheets feeds from said encasement;

(c) a picker mechanism associated with said encasement, said picker mechanism adapted to engage individual ones of the sheets to feed the sheets from the encasement;

(d) a support plate disposed in said encasement for supporting the sheets thereon interposed between said support plate and said separation tang, said support plate having a first segment canted relative to a second segment thereof and contacting the plurality of sheets for pressing the plurality of sheets against said separation tang;

(e) a hinge connected to the first segment for bearing the first segment against the column of sheets with a constant force as the sheets feed from said encasement, whereby the plurality of sheets presses against said separation tang with a predetermined force as the first segment bears against the plurality of sheets with the predetermined force, and whereby the step-wise topography of said separation tang cooperates with the constant force bearing against the plurality of sheets to allow individual feeding of sheets from said encasement; and (f) a spring connected to said support plate for upwardly biasing said support plate, so that the plurality of sheets individually contact said separation tang as the sheets feed from said encasement.

5. The sheet feeding apparatus of claim 4, wherein said picker mechanism comprises a feed roller.

6. A sheet feeding method comprising the steps of:

(a) providing a separation member having a step-wise topography for individually separating sheets from a column of sheets pressed thereagainst, the step-wise topography defining a downwardly-oriented step having an underside surface configured to contact each sheet over a predetermined area of the underside surface;

(b) providing a picker mechanism associated with said separation member, said picker mechanism adapted to engage individual ones of the sheets to feed the sheets from the column of sheets;

(c) providing a support member having a plurality of segments for supporting the plurality of sheets; and (d) providing an articulated joint associated with a predetermined one of the segments for pressing the segment against the plurality of sheets with a predetermined force, so that the sheets press against the separation member with the predetermined force; and (e) providing a biasing member connected to said support member for biasing said support member, so that the column of sheets supported by said support member contacts said separation member.

7. A sheet feeding method comprising the steps of:

(a) providing an encasement for accommodating a plurality of sheets to be fed therefrom;

(b) providing an separation member connected to the encasement and having a step-wise topography for individually separating the plurality of sheets, the step-wise topography defining a downwardly-oriented step having an underside surface configured to contact each sheet over a predetermined area of the underside surface;

(c) providing a picker mechanism associated with said encasement, said picker mechanism adapted to engage individual ones of the sheets to feed the sheets from the encasement;

(d) providing a support member associated with the encasement for supporting the plurality of sheets thereon, the support member having a canted segment thereof for pressing the plurality of sheets against the separation member;

(e) providing an articulated joint connected to the canted segment for pressing the canted segment against the plurality of sheets with a constant force, so that the plurality of sheets presses against the separation member with a predetermined force; and (f) providing a biasing member connected to the support member for biasing the support member, so that the plurality of sheets contacts the separation member.

8. The sheet feeding method of claim 7, wherein the step of providing a picker mechanism comprises the step of providing a feed roller.

9. A sheet feeding method comprising the steps of:

(a) providing a box-shaped encasement for accommodating a plurality of cut sheets to be fed therefrom;

(b) providing a separation tang connected to the encasement and having a step-wise topography for separating a first one of the sheets from a second one of the sheets as the sheets feed from the encasement, the step-wise topography defining a downwardly-oriented step having an underside surface of reduced contact area for contacting the first one of the sheets, so that the first one of the sheets has reduced contact time with the separation tang as the first one of the sheets feeds from the encasement;

(c) providing a picker mechanism associated with said encasement, said picker mechanism adapted to engage individual ones of the sheets to feed the sheets from the encasement;

(d) providing a support plate disposed in the encasement for supporting the sheets thereon interposed between the support plate and the separation tang, the support plate having a first segment canted relative to a second segment thereof and contacting the plurality of sheets for pressing the plurality of sheets against the separation tang;

(e) providing a hinge connected to the first segment for bearing the first segment against the plurality of sheets with a constant force as the sheets feed from the encasement, whereby the plurality of sheets presses against the separation tang with a predetermined force as the first segment bears against the plurality of sheets with the predetermined force, and whereby the step-wise topography of the separation tang cooperates with the predetermined force bearing against the column of sheets to allow individual feeding of sheets from the encasement; and (f) providing a spring connected to the support plate for upwardly biasing the support plate, so that the plurality of sheets individually contact the separation tang as the sheets feed from the encasement.

10. The sheet feeding method of claim 9, wherein the step of providing a picker mechanism comprises the step of providing a feed roller.

* * * * *